US009932538B2

(12) United States Patent
Sloan

(10) Patent No.: US 9,932,538 B2
(45) **Date of Patent: *Apr. 3, 2018**

(54) UNIVERSAL SYNTHETIC WATER DISPLACEMENT MULTI-PURPOSE PENETRATING LUBRICANT, METHOD AND PRODUCT-BY-PROCESS

(71) Applicant: BestLine International Research, Inc., Schenectady, NY (US)

(72) Inventor: Ronald J. Sloan, Blaine, WA (US)

(73) Assignee: Bestline International Research, Inc., Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/090,797

(22) Filed: Apr. 5, 2016

(65) Prior Publication Data

US 2016/0222315 A1 Aug. 4, 2016

Related U.S. Application Data

(63) Continuation of application No. 13/822,385, filed as application No. PCT/US2011/052279 on Sep. 20, 2011, now Pat. No. 9,309,482, which is a continuation of application No. 12/887,834, filed on Sep. 22, 2010, now Pat. No. 8,334,244.

(51) Int. Cl.

| | |
|---|---|
| ***C10M 169/04*** | (2006.01) |
| ***C10M 101/02*** | (2006.01) |
| ***C10M 105/04*** | (2006.01) |
| ***C10M 133/12*** | (2006.01) |
| ***C10M 135/10*** | (2006.01) |
| ***C10M 137/10*** | (2006.01) |

(52) U.S. Cl.

CPC ..... *C10M 169/04* (2013.01); *C10M 101/02* (2013.01); *C10M 105/04* (2013.01); *C10M 133/12* (2013.01); *C10M 135/10* (2013.01); *C10M 137/10* (2013.01); *C10M 169/044* (2013.01); *C10M 2203/102* (2013.01); *C10M 2203/1006* (2013.01); *C10M 2203/108* (2013.01); *C10M 2205/028* (2013.01); *C10M 2205/18* (2013.01); *C10M 2213/062* (2013.01); *C10M 2215/064* (2013.01); *C10M 2219/044* (2013.01); *C10M 2219/046* (2013.01); *C10M 2223/045* (2013.01); *C10N 2230/04* (2013.01); *C10N 2230/06* (2013.01); *C10N 2230/12* (2013.01); *C10N 2230/28* (2013.01)

(58) Field of Classification Search

CPC ..... C10M 105/04; C10M 101/02

USPC ..... 508/390, 369, 200; 208/19

See application file for complete search history.

(56) References Cited

U.S. PATENT DOCUMENTS

| | | | |
|---|---|---|---|
| 2,055,456 | A | 9/1936 | Eichwald |
| 2,124,628 | A | 7/1938 | Moser |
| 2,133,734 | A | 10/1938 | Moser |
| 2,270,577 | A | 1/1942 | Bergstrom et al. |
| 2,402,325 | A | 6/1946 | Greisinger et al. |
| 2,418,894 | A | 4/1947 | McNab et al. |
| 2,485,861 | A | 10/1949 | Sumner et al. |
| 2,501,731 | A | 3/1950 | Mertes |
| 3,406,419 | A | 10/1968 | Young |
| 3,480,550 | A | 11/1969 | Henderson |
| 3,984,599 | A | 10/1976 | Norton |
| 4,127,491 | A | 11/1978 | Reick |
| 4,131,551 | A | 12/1978 | Thompson et al. |
| 4,218,330 | A | 8/1980 | Shubkin |
| 4,224,170 | A | 9/1980 | Haugen |
| 4,224,173 | A | 9/1980 | Reick |
| 4,228,021 | A | 10/1980 | Lenack |
| 4,261,840 | A | 4/1981 | Gragson |
| 4,375,418 | A | 3/1983 | Zoleski et al. |
| 4,387,033 | A | 6/1983 | Lenack et al. |
| 4,443,348 | A | 4/1984 | Wright et al. |
| 4,483,195 | A | 11/1984 | Brown et al. |

(Continued)

FOREIGN PATENT DOCUMENTS

| | | | |
|---|---|---|---|
| CA | 2496921 | A1 | 8/2006 |
| CN | 1209452 | A | 3/1999 |

(Continued)

OTHER PUBLICATIONS

Rudnick, Leslie R., Ed., Synthetic Mineral Oils and Bio Based Lubricants: Chemistry and Technology, Taylor & Francis (2006).

Journal of Automotive Engineering, May 1, 2001, vol. 55, No. 5, pp. 67-72.

Journal of Automotive Engineering, May 1, 2001, vol. 55, No. 5, pp. 67-72, English translation of: p. 70, last paragraph; Figures 6 and 7.

Kioupis, L.I. ; Maginn, E.J., Molecular simulation of poly-{alpha}-olefin synthetic lubricants: Impact of molecular architecture on performance properties, Journal of Physical Chemistry B: Materials, Surfaces, Interfaces, amp Biophysical; Journal vol. 103; Journal Issue: 49; Dec. 9, 1999.

(Continued)

*Primary Examiner* — James C Goloboy
*Assistant Examiner* — Frank Campanell
(74) *Attorney, Agent, or Firm* — Jay R. Yablon

(57) ABSTRACT

A universal synthetic water displacement multi-purpose penetrating lubricant product-by-process with the capacity to protect metal surfaces against corrosion, with galvanic and electrolysis protection, while providing excellent lubrication properties. The lubricant actively penetrates the crystalline surface of the metal while exhibiting extreme pressure lubrication, non-migrating with lasting protection. The lubricant exhibits dielectric strength of over 14,000 volts, at the same time cleaning electrical contacts while reducing resistance and associated heat. A preferred embodiment comprises polymerized alpha-olefins, K-1 kerosene, and at least one base oil selected from the base oil group consisting of hydroisomerized high base oils and HT severe hydrocracked base oils. Various combinations of other optional ingredients are also disclosed.

8 Claims, No Drawings

(56) References Cited

U.S. PATENT DOCUMENTS

| | | | |
|---|---|---|---|
| 4,504,404 | A | 3/1985 | Schumacher et al. |
| 4,534,873 | A | 8/1985 | Clark |
| 4,543,195 | A | 9/1985 | Grangette et al. |
| 4,659,488 | A | 4/1987 | Vinci |
| 4,844,825 | A | 7/1989 | Sloan |
| 4,859,359 | A | 8/1989 | DeMatteo et al. |
| 4,879,053 | A | 11/1989 | Matthews et al. |
| 4,946,510 | A | 8/1990 | Kinnebrew et al. |
| 4,956,122 | A | 9/1990 | Watts et al. |
| 5,013,463 | A | 5/1991 | Slama |
| 5,120,358 | A | 6/1992 | Pippett |
| 5,136,118 | A | 8/1992 | Buchanan et al. |
| 5,169,564 | A | 12/1992 | Gallacher et al. |
| 5,202,040 | A | 4/1993 | Sanderson et al. |
| 5,332,516 | A | 7/1994 | Stephens |
| 5,364,994 | A | 11/1994 | Scharf |
| 5,431,841 | A | 7/1995 | Lockhart |
| 5,439,602 | A | 8/1995 | Eckard et al. |
| 5,505,867 | A | 4/1996 | Ritter |
| 5,578,235 | A | 11/1996 | Jao et al. |
| 5,631,211 | A | 5/1997 | Nakagawa et al. |
| 5,672,572 | A | 9/1997 | Araik et al. |
| 5,681,797 | A | 10/1997 | Lawate |
| 5,741,764 | A | 4/1998 | Patel et al. |
| 5,885,942 | A | 3/1999 | Zhang et al. |
| 5,888,281 | A | 3/1999 | Longo |
| 5,972,853 | A | 10/1999 | Boffa et al. |
| 6,008,164 | A | 12/1999 | Aldrich et al. |
| 6,046,142 | A | 4/2000 | Zilonis et al. |
| 6,074,993 | A | 6/2000 | Waddoups et al. |
| 6,143,701 | A | 11/2000 | Boffa |
| 6,323,162 | B1 | 11/2001 | Yasunori et al. |
| 6,413,916 | B1 | 7/2002 | Baumgart et al. |
| 6,551,967 | B2 | 4/2003 | King et al. |
| 6,761,645 | B1 | 7/2004 | Weber |
| 6,774,091 | B2 | 8/2004 | Dituro et al. |
| 6,858,567 | B2 | 2/2005 | Akao |
| 6,919,300 | B2 | 7/2005 | Dituro |
| 6,962,895 | B2 | 11/2005 | Scharf et al. |
| 6,992,049 | B2 | 1/2006 | Deckman et al. |
| 7,018,960 | B2 | 3/2006 | Negoro et al. |
| 7,022,766 | B2 | 4/2006 | Okada et al. |
| 7,055,534 | B2 | 6/2006 | Goode et al. |
| 7,109,152 | B1 | 9/2006 | Corby et al. |
| 7,124,728 | B2 | 10/2006 | Carey et al. |
| 7,745,382 | B2 | 6/2010 | Sloan |
| 7,776,233 | B2 | 8/2010 | Arafat et al. |
| 7,931,704 | B2 | 4/2011 | Sloan |
| 8,022,020 | B2 | 9/2011 | Sloan |
| 8,039,424 | B2 | 10/2011 | Sloan |
| 8,062,388 | B2 | 11/2011 | Sloan |
| 8,071,513 | B2 | 12/2011 | Sloan |
| 8,071,522 | B2 | 12/2011 | Sloan |
| 8,168,572 | B2 | 5/2012 | Thoen et al. |
| 8,268,022 | B2 | 9/2012 | Sloan |
| 8,334,244 | B2 * | 12/2012 | Sloan ..... C10M 169/044 208/19 |
| 8,377,861 | B2 | 2/2013 | Sloan |
| 3,415,280 | A1 | 4/2013 | Sloan |
| 3,491,676 | A1 | 7/2013 | Sloan |
| 8,623,807 | B2 | 1/2014 | Sloan |
| 8,771,384 | B2 | 7/2014 | Sloan |
| 9,034,808 | B2 | 5/2015 | Sloan |
| 9,284,507 | B2 | 3/2016 | Sloan |
| 9,309,482 | B2 | 4/2016 | Sloan |
| 2001/0036906 | A1 | 11/2001 | Locke et al. |
| 2003/0040444 | A1 | 2/2003 | Garmier |
| 2003/0087769 | A1 | 5/2003 | Dituro et al. |
| 2004/0014613 | A1 | 1/2004 | Dituro et al. |
| 2004/0060229 | A1 | 4/2004 | Todd et al. |
| 2004/0077506 | A1 | 4/2004 | Arrowsmith et al. |
| 2004/0102335 | A1 | 5/2004 | Carrick et al. |
| 2006/0160708 | A1 | 7/2006 | Sloan |
| 2008/0182769 | A1 | 7/2008 | Sloan |
| 2008/0190014 | A1 | 8/2008 | Volkel et al. |
| 2010/0269404 | A1 | 10/2010 | Sloan |
| 2010/0273687 | A1 | 10/2010 | Sloan |
| 2010/0273688 | A1 | 10/2010 | Sloan |
| 2011/0009301 | A1 | 1/2011 | Sloan |
| 2011/0015103 | A1 | 1/2011 | Sloan |
| 2011/0197499 | A1 | 8/2011 | Sloan |
| 2012/0035087 | A1 | 2/2012 | Sloan |
| 2012/0060410 | A1 | 3/2012 | Sloan |
| 2012/0077720 | A1 | 3/2012 | Sloan |
| 2012/0077724 | A1 | 3/2012 | Sloan |
| 2013/0157918 | A1 | 6/2013 | Sloan |
| 2013/0178403 | A1 | 7/2013 | Sloan |
| 2013/0298450 | A1 | 11/2013 | Sloan |
| 2014/0305030 | A1 | 10/2014 | Sloan |
| 2015/0247103 | A1 | 9/2015 | Sloan |

FOREIGN PATENT DOCUMENTS

| | | | |
|---|---|---|---|
| CN | 101805657 | A | 8/2010 |
| DE | 19723460 | A1 | 1/1998 |
| EP | 0361180 | A1 | 4/1990 |
| EP | 0837122 | A2 | 4/1998 |
| EP | 1203803 | A1 | 5/2002 |
| EP | 1736529 | A1 | 12/2006 |
| EP | 2619292 | A2 | 7/2013 |
| FR | 2193080 | | 7/1972 |
| JP | 59204700 | | 11/1984 |
| JP | 07233001 | | 9/1995 |
| JP | 2001-271077 | A | 10/2001 |
| WO | 1997019153 | | 5/1997 |
| WO | 2002034867 | A1 | 5/2002 |
| WO | 2003064571 | A1 | 8/2003 |
| WO | 2006-015800 | A1 | 2/2006 |
| WO | 2006100188 | A1 | 9/2006 |
| WO | 2007004789 | A1 | 1/2007 |
| WO | 2009078882 | A1 | 6/2009 |
| WO | 2009079020 | A1 | 6/2009 |
| WO | 2009085957 | A1 | 7/2009 |
| WO | 2009085967 | A1 | 7/2009 |
| WO | 2012-40153 | A2 | 3/2012 |
| WO | 2012-40153 | A3 | 3/2012 |

OTHER PUBLICATIONS http://www.sasoltechdata.com/MSDS/SASOLAB_C12L.pdf.

United States Environmental Protection Agency, "Status Report, Chemical Activities," Third Edition, vol. I (Jun. 1982), cover page, pp. 21, 38, 201.

40 CFR 700 to 789, Revised as of Jul. 1, 2006. cover page, p. 52.

Leslie R. Rudnick, Lubricant Additives: Chemistry and Applications, section 17.4.6, p. 428 (2009).

Corrosion Inhibitors, http://www.chemtura.com/bu/v/index.jsp?vgnextoid=2e6aeaa547e9f010VgnVCM100000b70215acRCRD&vgnextchannel=2e6aeaa547e9f010VgnVCM100000b70215acRCRD, printed on Jan. 22, 2014.

Calcinate C-300CS, http://www.chemtura.com/bu/v/index.jsp?vgnextoid=851c81a7bfd01110VgnVCM1000008ed7010aRCRD&vgnextchannel=2e6aeaa547e9f010VgnVCM100000b70215acRCRD&vgnextfmt=default, printed on Jan. 22, 2014.

* cited by examiner

UNIVERSAL SYNTHETIC WATER DISPLACEMENT MULTI-PURPOSE PENETRATING LUBRICANT, METHOD AND PRODUCT-BY-PROCESS

CROSS-REFERENCE TO RELATED APPLICATIONS

This application is a continuation of application U.S. Ser. No. 13/822,385 filed Mar. 12, 2013, which is now U.S. Pat. No. 9,309,482 issued Apr. 12, 2016. Said Ser. No. 13/822,385 is a US national stage application based on expired application PCT/US11/52279 filed Sep. 20, 2011. Said PCT/US11/52279 is a continuation of application U.S. Ser. No. 12/887,834 filed Sep. 22, 2010, now U.S. Pat. No. 8,334,244 issued Dec. 18, 2012.

FIELD OF THE INVENTION

This invention relates to the latest technology in the development of a universal synthetic water displacement multi-purpose spray penetrating lubricant capable of immunizing and protecting metal from oxidization caused by moisture, galvanic action, electrolysis, stray current, voltage leakage and induced current in marine applications, penetrating rust and corrosion caused by oxidation and harsh marine conditions, immunizing the state of the metal surface while providing cathodic protection and lubricating metal surfaces and creating barriers to resist salt water and chemicals, and offering extreme pressure lubrication capacities with a high dielectric protection. Marine corrosion causes billions of dollars of damage per year merely to provide replacement parts, not including costly down time or cost of manpower.

BACKGROUND OF THE INVENTION

Over the years, the marine industry has severely suffered from metal corrosion in the marine environment. Moisture, salt water, galvanic action and electrolysis between dissimilar metals have cost the industry greatly both in safety and maintenance costs. Current lubricating compounds that have been developed to penetrate rust and corrosion exhibit little protection against voltage leakage, induced current or stray current. Nor do they offer good lubrication qualities. Further many topical lubricants have been developed for lubrication but again exhibit little penetrating capacity or electrolysis protection. Of the many products developed, few have demonstrated extreme pressure capability while preventing corrosion from the marine environment. While there are several industrial products purporting to offer the benefit of dielectric strength, those tested were found to fall far short of their claims and offer little or no cathodic protection to the metal surfaces. Further there are a number of products developed to clean electrical contacts to reduce resistance and associated heat. However, these products sorely lack the ability to lubricate or penetrate rust and oxidation and protect against galvanic action.

It would be desirable to have available an effective multi-purpose penetrating lubricant with all of the desirable features mentioned in the foregoing.

SUMMARY OF THE INVENTION

Disclosed herein is a universal synthetic water displacement multi-purpose penetrating lubricant with the capacity to protect metal surfaces against corrosion, with galvanic and electrolysis protection, while providing excellent lubrication properties. The lubricant actively penetrates the crystalline surface of the metal while exhibiting extreme pressure lubrication, non-migrating with lasting protection. The lubricant exhibits dielectric strength of over 14 KV, at the same time cleaning electrical contacts, reducing resistance and associated heat. One preferred embodiment may contain Polymerized alpha-olefins, K-1 kerosene, high flash Aliphatics (Mineral Spirits) along with Hydroisomerized Base Oil with a very high viscosity index, Zinc Dialkyldithiophosphate and Synthetic Calcium Sulfonates. Many variations are possible in accordance with this disclosure and its associated claims, with the Polymerized alpha-olefins, K-1 kerosene, and base oil providing the common essential ingredients for all embodiments.

This universal synthetic water displacement multi-purpose penetrating lubricant has the ability to penetrate into the crystalline structure of the metal while providing a cathodic state of protection to the metal surface along with an being extreme pressure lubricant. This lubricant has the capacity to penetrate rust and corrosion caused by oxidation or harsh chemicals, galvanic action, electrolysis, stray current, voltage leakage and induced current, all of which cause severe damage within the marine environment. Further, the lubricant penetrates into the crystalline surface of the metal, leaving a non-migrating lasting lubricant with extreme pressure capabilities. Further the lubricant is able to clean electrical contacts for improved conductivity while offering insulation and isolation by way of an extremely high dielectric strength. Further, when applied to ferrous and non-ferrous material, this lubricant is resistant to many hostile elements and hazards presented by the marine environment.

This universal synthetic water displacement multi-purpose penetrating lubricant with anti-corrosion compound is formulated to be effective in highly corrosive conditions such as water, salt-water and mild acidic or basic condition. It is formulated with the ability to retard oxidation and rust on ferrous and non-ferrous metals, and to penetrate into the crystalline surface of metals and retard corrosion and oxidation while providing lasting protection within the subsurface surface and surface of the metal. The lubricant contains an extreme pressure agent to provide boundary lubrication under the most extreme pressure and environmental conditions involving water, salt-water, acids or base chemicals or blend of solutions. It will protect metal surfaces from oxidation caused by galvanic action, electrolysis, voltage leakage, induced current and stray current condition within marine applications.

This universal synthetic water displacement multi-purpose penetrating lubricant with anti-corrosion compounds with extreme pressure capability can be brushed on, sprayed, wicked or fed through a liquid feed configuration. It retards oxidation, corrosion and chemical reaction between ferrous and non-ferrous metals when in adverse condition.

This universal synthetic water displacement multi-purpose penetrating lubricant comprises polymerized alpha-olefins; k-1 kerosene; and at least one a base oil selected from the base oil group consisting of Hydroisomerized high base oils and HT Severe Hydro-cracked Base Oils; as well as other optional ingredients. Also disclosed are methods for producing this universal synthetic water displacement multi-purpose penetrating lubricant. The lubricant may also be used as a protective barrier on metal surfaces prior to their being painted with a solvent based paint.

DETAILED DESCRIPTION

The invention is for a universal synthetic water displacement multi-purpose penetrating lubricant and associated methods of use and production that can be used to immunize against or reduce metal oxidation caused by galvanic action, electrolysis, stray current, voltage leakage and induced current with further applications as a general penetrating liquid with the characteristics of dissolving and loosening corrosion and rust caused by oxidation or harsh chemicals. The lubricant further has the ability to penetrate into the crystalline surface of the metal leaving a lubricating film that is resistant to future corrosion brought on by harsh conditions from the marine environment. Further, the lubricant leaves a barrier film that has extreme pressure capacity, and acts as a solvent to remove oxidation between electrical contacts to allow maximum flow of electricity while reducing the resistance and heat associated with resistance. Although the lubricant cleans contacts for reduced resistance, it also isolates and insulates electrical contacts to protect the same from moisture and other such elements that can cause electrical shorts and failure. This lubricant demonstrates high dielectric strength while exhibiting the characteristics of a penetrant, lubricant, extreme pressure (EP) lubricant and contact cleaner and isolator from stray current associated with power-stations, industrial and marine applications including but not limited to electric motors.

Primary Ingredients

The finished product, in a preferred embodiment of the invention, is a novel and inventive combination of the following ingredients (elements), as a whole:

Polymerized alpha-olefins: This is a primary ingredient also known as alkenes, polymerized olefins, chlorowax waxes, and chlorinated paraffins whose carbon chain length are 12 to 24 with chloric weight percentage from 21.4 to 70%, an HCI of 4 to 10 ppm and molecular weight of 200 to 650 and Wt. Cl (2) from 20 to 70% with specific gravity at 78 degrees Fahrenheit or 25 degrees centigrade of 1.050 to 1.50 and a JQD weight percentage of HCL being 0.20 to 0.60 percent maximum or 2 to 15 ppm. Stokes 0.13 to 68, Poise 0.14 to 90, SUS 40 to 400 @210 degrees Fahrenheit or 100 degrees centigrade, 200 to 7000 at 100 degrees Fahrenheit or 37.8 degrees centigrade. Specific gravity 1.0 to 2.0. The primary use of Polymerized alpha-olefins is for lubricant formulations, lubricant additive compounds, coatings, extreme-pressure additive formulations and metal working compounds. Polymerized alpha-olefins are the most advanced synthetic alfa-olefins known in the art today, and are understood to include any future improvements that may be made to advance the state of the art for synthetic alfa-olefins. The "chloric or chlorination weight percentage" referred to above can alternatively be understood to range from less than 40%, 40 to 49%, 50 to 59%, 60 to 69% and greater than 70%. Likewise carbon chains can include C10 to C13, C14 to C17 and C18 to C30.

K-1 Kerosene: This primary ingredient is a triple filtered, clear, low sulfur, low odor complex mixture of paraffin/mineral oil, olefins and low aromatic hydrocarbons having hydrocarbon chain length predominately in the range of C9 through C16 (CAS 2006) and the molecule of C12H24. Preferred is a Flash Point of 120 to 190 degrees Fahrenheit or 49 to 88 degrees C., molecular weight of approximately 100 to 200, preferably pH neutral but in a pH range of 3 to 11, and a density of approximately 0.80 to 0.90 g/ml and a boiling range of 345 to 475 degrees Fahrenheit or 175 to 245 degrees centigrade. The total number of hydrogen atom is greater than the number of carbon atoms by a factor of 1.750 to 2.300. The preferred CAS number, which exemplifies, without limitation, the desired properties of this ingredient, is 8008-20-6. K-1 kerosene is used as fuel in low odor heaters, indoor lamps, as a carrier for insecticides and as a less filtered product sold as a jet fuel for aircraft jet engines.

Hydroisomerized High-Base Oils or HT (hydro-treated) Severe Hydro-cracked Base Oils: This primary ingredient is a severe hydro-cracked or hydroisomerized base oil with low or no aromatics and impurities, produced by chemically reacting the feed stock with hydrogen (3000 P.S.I.) to reduce or remove polar compounds containing sulphur, nitrogen and oxygen and to convert aromatic hydrocarbons to saturated cyclic hydrocarbons breaking up the heavy polycyclo-paraffin molecules to light saturated hydrocarbons. This may include fractionated oils that have been hydro-finished or hydro-polished. The base oils can be used in a host of lubricating oils, motor oils, cutting oils, and in food processing, pharmaceutical, industrial and agricultural lubricants and extreme pressure additives. These also add to the lubrication of ultra low sulfur diesel fuel.

Other Ingredients

Other desirable, albeit optional ingredients (elements) include the following, individually and, without limitation, in varying combinations:

High Flash Aliphatic Mineral Spirits: A colorless homogeneous solution of low odor, low aromatic with an evaporation rate of approximately 0.01 (n-butyl acetate=1) and referred to as petroleum distillates that have been synthesized from selected hydrocarbons. This is also referred to as Stoddard Solvent #3 and/or Mineral Spirits, and is commonly used as a cleaning solvent, solvent in aerosols, paints, varnishes and paint thinners for household and commercial use and has been subjected to hydrodesulfurization solvent extraction with a mixture of saturated aliphatic and alicyclic C7 to C12 with a maximum of 40%. The flash point ranges from 168 to 176 degrees Fahrenheit or 75 to 80 degrees centigrade, with an aniline point of 140 to 186 degrees Fahrenheit or 60 to 85 degrees centigrade, a vapor density at about 58 degrees Fahrenheit or 15 degrees centigrade kg/L of an average value of approximately 0.750 to 0.850.

Synthetic Calcium Sulfonates: Over based calcium sulfonates with a TBN of 100 to 600. This ingredient is primarily employed for extreme pressure additive formulations offering corrosion protection, dispersants and detergency in oil soluble additives for ferrous and non-ferrous metals with a minimum calcium weight of 10.00 to 20.00%, a total base number, mg KOH/g (ASTM D-2896) of 100 to 600 and an average molecular weight (ASTM D-3712) of 800 to 1200.

Solvent activated dye: An alcohol (NAHA) solution of polymer color-forming compounds. These are commonly used to identify grades or designated uses of fuels and lubricants. They are produced in both powder and liquid form and when introduced to the product, are stable, and leave an identifiable color to the product. This can be any color including blue for gun bluing.

Polytetrafluoroethylene (fluoroadditive): CAS No 9002-84-0. Fluoroadditives are organic polymers in colloidal form that when blended into a solvent base compound and applied are highly resistant to water or weathering conditions. Viscosity of 400 cP@ 77 degrees Fahrenheit or 25 degrees centigrade is typical. The flash point is approximately 385 degrees Fahrenheit or 196 degrees centigrade.

ZDDP (zinc dialkyldithiophosphate) CAS Number 68649-42-3 with Specific Gravity of 1.10 to 1.14 at 60 degrees Fahrenheit or 20 degrees centigrade, viscosity of approximately 100 mm2/s (kinematic value) @ 104 degrees Fahrenheit or 40 degrees centigrade containing 6 to 10 percent weight of zinc, 6 to 10 percent weight of phosphorus and 13 to 19 percent weight of Sulphur and a flash point of 285 to 320 degrees Fahrenheit or 140 to 160 degrees centigrade (ASTM D 92).

Common Moellen Degrass: CAS 8020-84-6, EINECS Number 232-418-6, Density 0.94 to 0.97, Free Fatty Acid 15 to 30%, Iodine Value 20 to 40, Melting Point 95 to 122 degrees Fahrenheit or 35 to 49 degrees centigrade, Flash Point of 825 to 880 degrees Fahrenheit or 440 to 470 degrees centigrade, Open Cup.

Synthetic thioxtropic Calcium Sulfonate: CAS 64742-88-7, Flash point Over 158 degrees Fahrenheit or 70 degrees centigrade, Specific Gravity 0.95 at 60 degrees Fahrenheit or 15.6 degrees centigrade, Percent Volatile 27 to 30%, Viscosity 11000 to 13000 Centipoise at 78 degrees Fahrenheit or 25 degrees centigrade. Thioxtropic Calcium Sulfonate is a stabilizer for the Rheological control of finished products.

Alkaryl amine: CAS 122-39-4 containing up to 5% by weight of Diphenylamine. Flash point is typically 338 degrees Fahrenheit or 170 degrees centigrade by PMCC (ASTM D93), specific gravity of 0.96 at 60 degrees Fahrenheit or 15.6 degrees centigrade, pour point of 5 degrees Fahrenheit or minus 15 degrees centigrade, typical viscosity 1845 Centipoise at 68 degrees Fahrenheit or 20 degrees centigrade.

Preferred Blending Ratios

The preferred blending ratios for each component/ingredient/element are shown as below. It is important to maintain a blend of ingredients that fall within the following percentages. Note the ratios shown below are based on a product which contains all of the "primary" and "other" ingredients listed above, and that the "most preferable" percentages sum to 100%. It is inherent and obvious, and in any event is to be expressly understood, that for embodiments which omit one or more of these ingredients, the percentages by weight of the remaining ingredients are to be proportionately increased:

Polymerized Alpha-Olefins: 2 to 30 percent by weight and preferably 7.0 to 25 percent by weight and more preferably 9.0 to 22 percent by weight. Most preferable is 17.0 percent by weight.

K-1 Kerosene: 5 to 60 percent by weight and preferably 7.5 to 40 percent by weight and more preferably 10 to 30 percent by weight. Most preferable is 20 percent by weight.

Hydroisomerized High-Base Oils and HT (hydro-treated) Severe Hydro-cracked Base Oils: 7 to 55 percent by weight and preferably 10 to 42 weight percent and more preferably 15 to 35 percent by weight. Most preferable is 27.5 percent by weight.

High Flash Aliphatic Mineral Spirits: 15 to 60 percent by weight and preferably 20 to 55 weight percent and more preferably 22 to 39 percent by weight. Most preferable is 25 percent by weight.

Synthetic Calcium Sulfonates: 0.20 to 15 percent by weight, preferably 0.50 to 10 percent by weight and more preferably 0.75 to 5 percent by weight. Most preferable is 1.50 percent by weight.

Solvent Activated Dyes: 0.002 to 0.010 percent by weight and preferably 0.0025 to 0.004 percent by weight and more preferably 0.0027 to 0.0035 percent by weight. Most preferable is 0.003 percent by weight.

Polytetrafluoroethylene (fluoroadditive): 0.100 to 8.00 percent by weight and preferably 0.102 to 1.99 percent by weight and more preferably 0.105 to 0.885 percent by weight. Most preferable is 0.747 percent by weight.

ZDDP (zinc dialkyldithiophosphate): 0.50 to 25 percent by weight and preferably 1 to 7.5 percent by weight and more preferably 1.50 to 5 percent by weight. Most preferable is 2 percent by weight.

Common Moellen Degrass: 0.50 to 30 percent by weight and preferably 2 to 20 percent by weight and more preferably 2.5 to 10 percent by weight. Most preferable is 3.5 percent by weight.

Synthetic thioxtropic Calcium Sulfonate: 0.25 to 20 percent by weight and preferably 0.50 to 10 percent by weight and more preferably 0.75 to 5 percent by weight. Most preferable is 1.25 percent by weight.

Alkaryl amine: 0.50 to 20 percent by weight and preferably 0.75 to 10 percent by weight and more preferably 1 to 5 percent by weight. Most preferable is 1.5 percent by weight.

Preferred Sequence of Blending Components

A preferred method of producing this lubricant employs the following prescription:

The initial blend (primary blend) requires the Polymerized Alpha Olefins, the K-1 Kerosene and the Base Oil being blended until the liquid is a consistent amalgamation without the appearance of separation. Blending is based on speed of the agitator and temperature will dictate the amount of time for the blend to complete, in accordance with principles known in the art. The blending time range may vary from 4 to 6 hours. The ideal temperature for each component is between 71 to 86 degrees Fahrenheit or 22 to 30 degrees centigrade for ideal blending. While this is blending, a secondary blend for the high flash aliphatic mineral spirits and synthetic calcium sulfonates, as well as, if used for a particular embodiment, the solvent activated dye and the fluoroadditive, is prepared in a much smaller high speed enclosed blender, and then added to the primary blend.

The aliphatic mineral spirits are blended with the synthetic calcium sulfonates (thioxtropic or other) in an approximate 75/25 ratio in the initial stage of the blend to produce the secondary blend. (The aliphatic mineral spirits used will be blended to achieve the preferred blending ratios set forth earlier.) High flash aliphatic mineral spirits and the zinc dialkyldithiophosphate, if employed, are further combined into a tertiary blend. The secondary and, if used for a particular embodiment, the tertiary blend, or the mineral spirits alone if the embodiment in question omits the synthetic calcium sulfonates, together with the balance of whatever ingredients are employed, can be then added to the main blend. The agitator is run until the components appear to have thoroughly blended into a consistent liquid.

Variations to this blending process for certain particular combinations of ingredients are also further described in the claims filed herewith, which under settled principles of patent law are understood to also be part of the disclosure of the invention.

Thus, for illustrative example not limitation, for an embodiment of the lubricant comprising polymerized alpha-olefins, K-1 kerosene, at least one base oil, high-flash aliphatic mineral spirits and synthetic calcium sulfonates, the lubricant is produced by a method comprising: blending the polymerized alpha-olefins, the K-1 kerosene, and the at least one base oil until the blend is a consistent amalgamation without any appearance of separation, thereby producing a primary blend; and separately blending the high-flash aliphatic mineral spirits and the synthetic calcium sulfonates, thereby producing a secondary blend; and adding the secondary blend to the primary blend.

Also, for illustrative example not limitation, for an embodiment of the lubricant comprising polymerized alpha-olefins, K-1 kerosene, at least one base oil, high flash aliphatic mineral spirits and synthetic thioxtropic calcium sulfonates, the lubricant is produced by a method comprising: blending the polymerized alpha-olefins, the K-1 kerosene, and the at least one base oil until the blend is a consistent amalgamation without any appearance of separation, thereby producing a primary blend; separately blending the high flash aliphatic mineral spirits and the synthetic thioxtropic calcium sulfonates, thereby producing a secondary blend; and adding the secondary blend to the primary blend.

Further, for illustrative example not limitation, for an embodiment of the lubricant comprising polymerized alpha-olefins, K-1 kerosene, at least one base oil, high flash aliphatic mineral spirits, synthetic calcium sulfonates, solvent activated dye, fluoroadditive, zinc dialkyldithiophosphate, and at least one common moellen degrass, the lubricant is produced by a method comprising: blending the polymerized alpha-olefins, the K-1 kerosene, and the at least one base oil until the blend is consistent amalgamation without any appearance of separation, thereby producing a primary blend; separately blending the high flash aliphatic mineral spirits, the synthetic calcium sulfonates, the solvent activated dye, and the fluoroadditive thereby producing a secondary blend; separately blending the high flash aliphatic mineral spirits and the zinc dialkyldithiophosphate, thereby producing a tertiary blend; and adding the secondary and tertiary blends and the at least one common moellen degrass ("the balance of whatever ingredients are employed"), to the primary blend.

Finally, for illustrative example not limitation, for an embodiment of the lubricant comprising all of the primary and other ingredients earlier disclosed, the lubricant is produced by a method comprising: blending the polymerized alpha-olefins, the K-1 kerosene, and the at least one base oil until the blend is consistent amalgamation without any appearance of separation, thereby producing a primary blend; separately blending the high flash aliphatic mineral spirits, the synthetic calcium sulfonates, the solvent activated dye, and the fluoroadditive thereby producing a secondary blend; separately blending the high flash aliphatic mineral spirits and the zinc dialkyldithiophosphate, thereby producing a tertiary blend; and adding the secondary and tertiary blends, the at least one common moellen degrass, the synthetic thioxtropic calcium sulfonate, and the alkaryl amine ("the balance of whatever ingredients are employed"), to the primary blend.

Other methods of producing this lubricant for combinations of ingredients not expressly discussed above, following the prescriptions set forth above, are also regarded to be within the scope of this disclosure and its associated claims.

Preferred Blending Equipment

The process sequence involves a series of blending and holding tanks where the product is weighed and then pumped through control valves to maintain consistent flow and pressure, in desired blending ratios as previously disclosed. The blending should be performed in an enclosed tank to reduce product evaporation (loss) and prevent exposure to open spark. Blending equipment can be by a combination of high or low speed blending apparatus. Size or volume of tank is not critical to the blend.

Multi Functional Use of Invention

The universal synthetic water displacement multi-purpose penetrating lubricant can be used in many marine and industrial settings in extreme and harsh conditions. It can also be used in various forms of machining, wire rope cleaning and lubrication, and electrical applications where elements such as salt water are a constant source of shorting and electrical safety and failure are a concern. The universal synthetic water displacement multi-purpose penetrating lubricant has been tested as an extreme pressure topical lubricant and has exceeded the performance of presently available lubricants. Finally the universal synthetic water displacement multi-purpose penetrating lubricant has been severely tested on applications of extreme rust and corrosion and has demonstrated the ability to penetrate and loosen the same while leaving a protective barrier on the metal. The universal synthetic water displacement multi-purpose penetrating lubricant in testing has shown its ability to work well with ferrous and non-ferrous material with profound results.

This universal synthetic water displacement multi-purpose penetrating lubricant has a vast variety of possible uses, including for example, but not limited to, guns, ice-skate blades, skis, snow boards, brake rotors, jet engine fans, boat hulls, cables, wire-rope, rode (anchor chain), fishing reels, hinges, latches, bearings, knives, electrical cables and contacts, air filters, valves, sea-cocks, propellers, out-board engines, out-drives, bolts and nuts, tools, air tools, electric motors and pumps and other marine and mechanical/electrical applications.

Testing Procedures and Results

This universal synthetic water displacement multi-purpose penetrating lubricant is unique in its field and has such has been tested on the Timken Bench Tester and has shown that it has the capacity to exceed the lubrication capacity of an engine lubricant many times over. When tested the average engine lubricant failed at 5 to 7 foot-pounds. The average penetrant failed at less than 2 foot-pounds. This universal synthetic water displacement multi-purpose penetrating lubricant exceeded 30 foot-pounds of destructive weight. Further when tested for dielectric strength, the invention exhibited the capacity of over 8000 volts protection. When the universal synthetic water displacement multi-purpose penetrating lubricant was experimentally tested in machine, tapping and drilling, the lubricant allowed the tool to leave a highly refined finish on the points of contact and pressure.

As there is no particular ASTM-D test protocol to measure the ability of a universal synthetic water displacement multi-purpose penetrating lubricant, the inventor has had to rely on actual results from hands-on use of the lubricant in various fields of testing. This lubricant has been successfully tested on an experimental basis in many of the marine, industrial, electrical and other uses noted above, and has yielded following test results:

1. Experimental testing was conducted using both handguns and automatic rifles. Each revolver was fired a minimum of 2,500 rounds per week for 6 weeks for a total of 15,000 rounds. No malfunctions of any kind were encountered. The make, model and caliber of the handguns used varied but included the 1911A1 in 45 ACP, the Glock 9 mm, the Beretta M92-9 mm, and the Smith and Wesson M10-38 caliber revolver.

The rifles involved in this evaluation are newly purchased Colt AR-15/M16 semi or fully automatic rifles. They are caliber .223 or 5.56×45 mm. Six new rifles were used during the evaluation. The new M16 type rifles were purchased by a United States Sheriffs Department. The rifles were removed from their shipping packages, visually inspected to ensure they were safe to fire and were test fired with one magazine each. The rifles were then disassembled and cleaned to remove all previous oils or grease and then lubricated with the universal synthetic water displacement multi-purpose penetrating lubricant. Each of the six rifles was then fired a minimum of 500 rounds per day for 10 consecutive days for a total of at least 30,000 rounds of ammunition expended.

Individuals within the United States Sheriff's Department trained in the handling guns conducted the experimental testing and firing of both long-guns and pistols. No malfunctions of any kind were encountered during the evaluation of the lubricant, and the guns remained clean, cool, accurate and lubricated throughout the tests.

2. Experimental testing was conducted on a U-100 unlimited hydroplane capable of speeds in excess of 200 miles per hour. These boats come in fiberglass, 30 feet in length, and 14-15 feet in width. The boats weigh in at 6800 pounds and are powered by Lycoming T-55L-7 Chinook 3000 horsepower turbine engines. The test boat's hull, propeller, rudders, skags and turbine fan blades were treated with the lubricant. The boat raced in extreme saline condition exceeding speed of 200 miles per hour.

The results in comparison with an untreated boat was the following: The boat treated with the lubricant retained a lubricant film on the hull and did not experience salt adhesion. The propeller, rudder and skags remained shiny and retained the sharp edges while the turbine fan blades remained free of salt accumulation maintaining the engine balance and performance.

3. Closed loop geo-thermal systems experience electrical discharge created by the movement of salts and minerals with the water being pumped. This electrical discharge over time will attach to the casings of electric motors and pumps, oxidizing the metal/alloys within the casing, thus reducing their effective life. The pumps and electric motors act as a cathode oxidizing the metal/allow casings over time. The universal synthetic water displacement multi-purpose penetrating lubricant was used in experimental testing to spray the electric motors and pump casings experiencing metal corrosion. The lubricant halted the oxidation by immunizing the metal and remained effective for over six months before re-application.

4. The lubricant was experimentally tested on the skate blades of professional hockey players and was shown under severe skating movement to maintain the sharpness of the edges while giving the skate greater speed and improved stopping capabilities.

5. The lubricant was experimentally tested on brake rotors and demonstrated the ability to reduce the oxidation and corrosion experienced on vehicles sitting in humid areas. Further the lubricant was found to improve the braking action and reduce heat. In racing applications, the lubricant when applied upon brake rotors for experimental testing extended the life of the brake-pads and rotors.

While this experimental testing has demonstrated the ability of the invention to yield dramatic improvement in all the fields of testing, this product by virtue of these tests shows the clear inherent potential of exhibiting positive results in areas yet to be considered or tested. Any such benefits and uses which are inherent in this product albeit not explicitly considered or tested to date, are nonetheless to be regarded as falling within the scope of this disclosure and its associated claims.

The knowledge possessed by someone of ordinary skill in the art at the time of this disclosure is understood to be part and parcel of this disclosure and is implicitly incorporated by reference herein, even if in the interest of economy express statements about the specific knowledge understood to be possessed by someone of ordinary skill are omitted from this disclosure. While reference may be made in this disclosure to the invention comprising a combination of a plurality of elements, it is also understood that this invention is regarded to comprise combinations which omit or exclude one or more of such elements as well as precise combinations not expressly disclosed or claimed, even if this omission or exclusion of an element or elements is not expressly stated herein, unless it is expressly stated herein that an element is essential to applicant's combination and cannot be omitted. It is further understood that the related prior art may incorporated herein by reference may include elements from which this invention may be distinguished by negative claim limitations, even without any express statement of such negative limitations herein. It is to be understood, between the positive statements of applicant's invention expressly stated herein, and the prior art and knowledge of the prior art by those of ordinary skill which is incorporated herein even if not expressly reproduced here for reasons of economy, that any and all such negative claim limitations supported by the prior art are also considered to be within the scope of this disclosure and its associated claims, even absent any express statement herein about any particular negative claim limitations.

Finally, while only certain preferred features of the invention have been illustrated and described, many modifications, changes and substitutions will occur to those skilled in the art. It is, therefore, to be understood that the appended claims are intended to cover all such modifications and changes as fall within the true spirit of the invention.

I claim:

1. A synthetic water displacement multi-purpose penetrating lubricant product-by-process for improving lubrication, corrosion protection, penetration of oxidized materials, and cleaning of electrical contacts while providing dielectric insulation, produced by a process comprising:

blending polymerized alpha-olefins, K-1 kerosene, and at least one base oil selected from the base oil group consisting of hydroisomerized base oils and hydrocracked base oils, until the blend is a consistent amalgamation without the appearance of separation, thereby producing a primary blend.

2. The product-by-process of claim 1, further comprising:

blending aliphatic mineral spirits and synthetic calcium sulfonates in an approximate 75 percent to 25 percent ratio, thereby producing a secondary blend; and adding said secondary blend to said primary blend.

3. The product-by-process of claim 2, said synthetic calcium sulfonates comprising synthetic thioxtropic calcium sulfonates.

4. The product-by-process of claim 2, further comprising:

blending aliphatic mineral spirits and zinc dialkyldithiophosphate, thereby producing a tertiary blend; and adding said secondary and tertiary blends to said primary blend.

5. The product-by-process of claim 1, further comprising:

blending aliphatic mineral spirits, synthetic calcium sulfonates, solvent activated dye and fluoroadditive, thereby producing a secondary blend; and adding said secondary blend to said primary blend.

6. The product-by-process of claim 5, further comprising:

blending aliphatic mineral spirits and zinc dialkyldithiophosphate, thereby producing a tertiary blend; and adding said secondary and tertiary blends to said primary blend.

7. The product-by-process of claim 5, further comprising:

blending said aliphatic mineral spirits and said synthetic calcium sulfonates in an approximate 75 percent to 25 percent ratio;

blending aliphatic mineral spirits and zinc dialkyldithiophosphate, thereby producing a tertiary blend; and adding said secondary and tertiary blends and at least one moellen degrass to said primary blend.

8. The product-by-process of claim 5, further comprising:

blending aliphatic mineral spirits and zinc dialkyldithiophosphate, thereby producing a tertiary blend; and adding said secondary and tertiary blends and at least one moellen degrass, synthetic thioxtropic calcium sulfonate, and thioxalkaryl amine to said primary blend.

* * * * *